United States Patent [19]

Shafer

[11] 4,093,138

[45] June 6, 1978

[54] PORTABLE HOLDER FOR RIBBON-LIKE MATERIAL

[76] Inventor: Robert E. Shafer, 185 Shady Lake Dr., Hurst, Tex. 76053

[21] Appl. No.: 696,122

[22] Filed: Jun. 14, 1976

[51] Int. Cl.[2] ..... B65H 75/02; B65H 75/26; B65H 19/02

[52] U.S. Cl. ..... 242/55.2; 225/66; 225/67; 242/75.2; 242/85; 242/105; 242/106

[58] Field of Search ..... 242/55.2, 75, 75.2, 242/75.45, 55.53, 55, 85, 106, 105; 225/66, 67, 68, 69, 70, 71, 61, 65

[56] References Cited

U.S. PATENT DOCUMENTS

| | | | |
|---|---|---|---|
| 301,596 | 7/1884 | Hopking | 242/55.2 X |
| 931,294 | 8/1909 | Griesbeck | 242/105 |
| 1,624,235 | 4/1927 | Hall | 225/68 |
| 2,205,645 | 6/1940 | Currier | 225/67 |
| 3,612,426 | 10/1971 | Germock, Jr. | 242/85.1 |

FOREIGN PATENT DOCUMENTS

| | | | |
|---|---|---|---|
| 544,591 | 4/1942 | United Kingdom | 242/105 |
| 1,020,792 | 2/1966 | United Kingdom | 242/85 |

*Primary Examiner*—George F. Mautz
*Attorney, Agent, or Firm*—Charles W. McHugh

[57] ABSTRACT

A portable apparatus for holding and dispensing a coiled strip of ribbon-like material, such as tack strip which is used in the upholstery business, includes a pair of parallel rods which are rigidly connected at first end thereof, with the length of said rods being substantially longer than the radius of a full coil of the material. The separation of the rods is only slightly greater than the width of the ribbon-like material. An arm is pivotably connected to and mounted between the pair of rods intermediate the length of said arm and relatively near one end thereof, so as to divide the arm into longer and shorter portions. The longer portion of the arm is curved inwardly to the extent that its distal end lies near the periphery of a coil of the material. Means, such as a cotter pin, holds the coil between the rods. A spring is mounted for biasing the arm toward general longitudinal alignment with the rods. A generally U-shaped foot is secured to the distal end of the longer portion of the pivoted arm, with the open part of the foot being oriented inwardly toward the rods to encompass and bear against a peripheral portion of the coil of material. The coiled strip is restrained along a radial line that extends from the center of the coil out to the periphery thereof and at a remote point, at the periphery of the coiled material located approximately 90° from the radial line.

5 Claims, 5 Drawing Figures

PORTABLE HOLDER FOR RIBBON-LIKE MATERIAL

This invention is generally directed to a holder (and dispenser) for strip material in roll form, wherein the holder need not be attached to any fixed structure—so that it may be carried by a workman to most any worksite. More particularly, the invention relates to a holder for tack strip or other ribbon-like material which is used in the upholstery trade.

In the upholstery trade, it has long been known to use a strip of firm (but flexible) material as a means of securing the edges of a piece of cloth to a supporting structure. Such material is commonly called tack strip, and it has been conventionally supplied for many years in coiled form. Tack strip is usually either ⅜ inch wide or ½ inch wide; and about 500 feet of such material will usually be wound into a coil that is about 15 to 20 inches in diameter. While the basic material has been around for many years, there has never been an efficient and compact holder for storing the material when it is not in use—or for dispensing the material when it is needed by a workman. In the past a worker has typically affixed a roll of the tack strip to a wall near his work station or to a piece of plywood—by nailing a wooden spool or the like to some flat surface and then loosely placing the roll over said spool. It should be obvious that the technique of mounting the tack strip on a wall did not foster economy of movement by a worker, since he always had to return to a fixed location in order to tear off a piece of tack strip when he needed it. Those workers who chose to avoid a fixed supply point for tack strip usually created a portable supply point by merely nailing a small spool to a piece of plywood. Then, as long as the plywood was not inadvertently turned over, the coil of tack strip would remain in place on top of the plywood. If the plywood should accidentally be knocked over, however, the coil of tack strip might become damaged to the extent of being useless—if it became kinked, dirty or otherwise fouled as it fell to the floor and perhaps became tangled. Accordingly, it is an object of this invention to provide a portable holder for tack strip or other ribbon-like material.

It is an additional object to provide a holder which is sufficiently light and compact that a person performing an upholstery job can readily pick up and carry the holder with him as he moves around a piece of furniture or the like.

Another object is to provide a compact holder for ribbon-like material in which an element that serves to keep the material tightly wound in a coil also serves as a tear point—so that a clean edge can be achieved in the material by pulling said material against a sharp edge.

These and other objects and advantages will be apparent from a thorough study of the specification and claims appended hereto, and from an examination of the drawing in which:

In brief, the invention comprises a holder for a coiled strip of narrow, ribbon-like material—such as tack strip used in the upholstery trade. The holder comprises three relatively long arms, two of which are rigidly held together and spaced apart by a distance which is just slightly larger than the width of a roll of material that is to be secured in the holder. The third arm is pivotably mounted between the other two arms, and biased by a spring so that the distal end of the third arm bears against the periphery of a coil of held material. In order to insure that the coil of material will not somehow become deformed or unwound, an inwardly facing U-shaped foot is mounted at the distal end of the third arm. When a short strip of material is to be removed from the coil, the U-shaped foot serves as an anchor point against which the strip can be pulled—for tearing the same from the coil.

Figure 1:
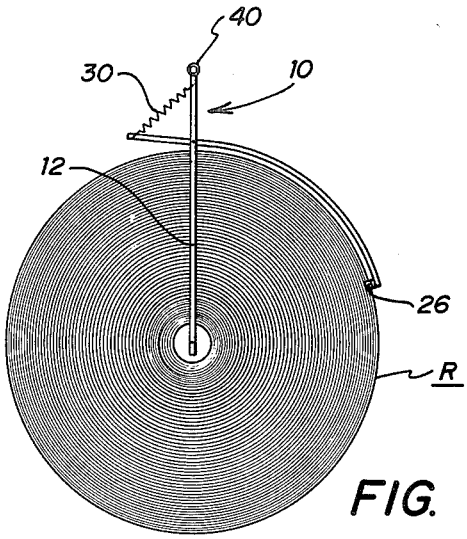
FIG. 1 is a front elevational view of the apparatus for holding a coil of ribbon-like material, with a coil of tack strip shown mounted on the apparatus.
Figure 2:
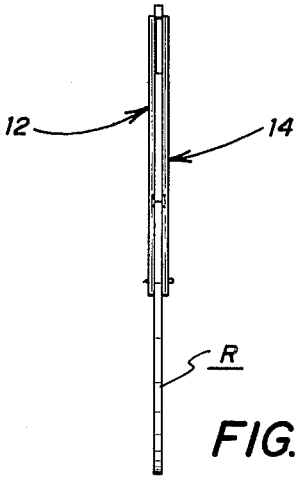
FIG. 2 is an edge view of the holder and the coil of material shown in FIG. 1.
Figure 3:
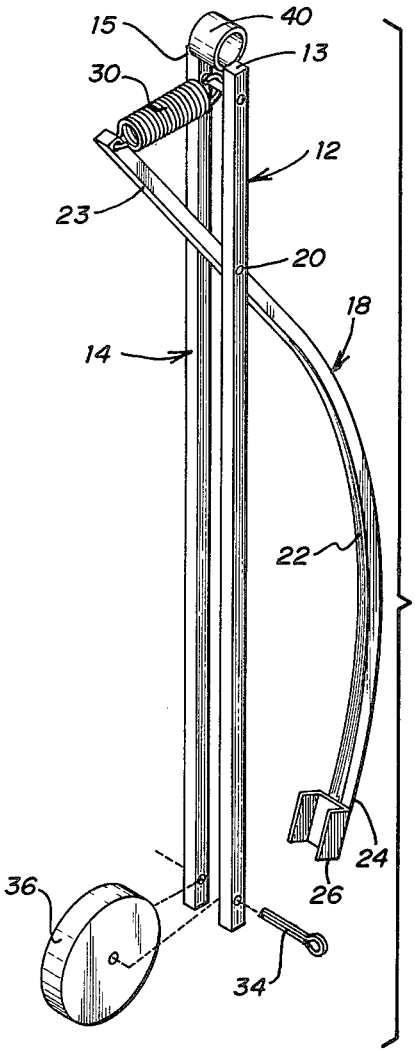
FIG. 3 is a perspective view of the portable apparatus as shown in FIG. 1, with the apparatus being shown empty, and a core for holding a coil of ribbon-like material being removed from the apparatus.
Figure 4:
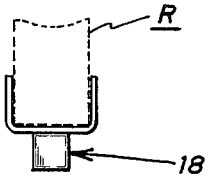
FIG. 4 is a fragmentary end view of the distal end of the pivotable arm, and specifically showing the U-shaped foot that helps maintain the coiled material in the plane defined by two parallel (and radial) arms and the U-shaped foot.
Figure 5:
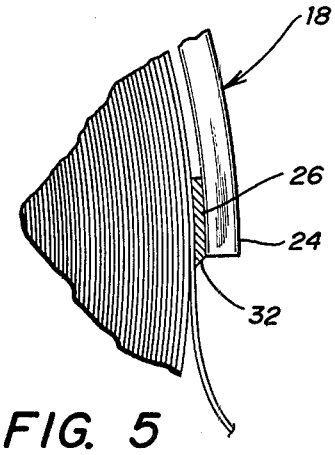
FIG. 5 is a fragmentary view of a peripheral portion of a coil of tack strip, taken in the plane V—V indicated in FIG. 4.

Referring initially to FIGS. 1, 2 and 3, the holder 10 is shown with a roll of upholstery tack strip mounted thereon. The holder 10 includes a pair of parallel rods 12, 14 which are rigidly connected at their first ends 13, 15. The length of the rods 12, 14 is substantially longer than the radius of a full coil of material, and the separation of the pair of rods is just slightly greater than ½ inch, i.e., slightly more than the width of a roll of commercially available tack strip. By spacing the rods about ½ inch apart, the holder will also accommodate tack strip which is ⅜ inch wide. Since tack strip is commercially available in rolls measuring about 20 inches in diameter, the rods 12, 14 should be at least 14 inches long. A preferred material for the parallel rods 12, 14 is steel, and said rods preferably have a generally square cross section. The reason for preferring a square cross-section is to provide two planar faces on said rods 12, 14 which confront each other and serve to restrain the coiled material so as to keep it in a generally flat position. By making the confronting faces about ¼ inch wide in a plane that is generally parallel to the sides of the coiled material, said material will be appropriately restrained along a radial line that extends from the center of the coil out to the periphery thereof. By the term "restrained", it is intended to mean that one layer of the material is held against sliding with respect to an adjacent layer in a direction perpendicular to the plane of the coiled tack strip.

A further and integral part of the holding apparatus 10 is an arm 18 which is pivotably connected to the pair of rods 12, 14 intermediate the length of said arm and relatively near one end thereof, so as to divide the arm into longer and shorter portions 22, 23. In a preferred embodiment, the pivot point 20 for the arm 18 is about one-fifth of the distance from one end of said arm, so as to divide the arm into portions whose respective lengths have a ratio of about 4:1. The arm's longer portion 22 is preferably curved inwardly, to the extent that its distal end 24 lies near the periphery of a roll R of the ribbon-like tack strip.

Rigidly connected to the distal end 24 is a generally U-shaped foot 26. The open part of the foot 26 is oriented so as to point inwardly toward the rods 12, 14.

When there is coiled material installed in the holder 10, the U-shaped foot 26 is adapted to encompass a peripheral portion of the material, by virtue of the fact that the gap between the two legs of the U-shaped foot is slightly wider than the width of the coiled material. Assuming that the widest material which will ever be held by the apparatus is ½ inch, then the two legs of the U-shaped member 26 would be spaced, about, say ⅝ inch apart. As for the length of said legs, they preferably are at least ¼ inch deep, so that they will encompass several layers of the coiled material. As a minimum it is believed that the legs should encompass at least two thicknesses of the coiled material, which—in the case of most cardboard tack strip—would be 2 × 0.040 or about 0.080. But, for manufacturing ease, it is simpler to design the legs quite a bit oversize; any manufacturing tolerance on the low side would then still leave plenty of side restraint on the periphery of the coiled strip. Thus, ¼ inch has been set as a preferred interior length for such legs. The U-shaped element 26 will typically be permanently attached to the rigid arm 18, as by welding. And, when the arm 18 is made of ¼ inch square steel bar stock, both the arm and the U-shaped element will form a substantially rigid structure for holding and stabilizing a coil of material held by the apparatus 10.

A spring 30 is also provided so as to bias the arm 18 toward general longitudinal alignment with the two parallel rods 12, 14. The spring 30 in the embodiment shown in FIGS. 3 is a helical coil tension spring having a length of about one inch and a formed diameter of about 5/16 inch. Such a spring 30 having a spring constant of about 0.20 is adequate to cause the U-shaped element 26 to bear against the periphery of a roll R with a force of about 3 pounds. By providing a downwardly facing cutting edge 32 near the bottom of the U-shaped foot 26, a piece of the tack strip may be manually pulled outwardly and upwardly against said cutting edge 32 in order to permit a piece of the tack strip to be readily torn from the coil. If a pronounced "knife edge" is omitted at the bottom of the foot 26 (as a way of promoting simplicity in manufacturing), it is at least preferred that the bottom edge be relatively "sharp" rather than "rounded"—so as to foster ease in tearing off a piece of the ribbon-like material.

Also, in the preferred embodiment of the invention there is provided a means for releasably and rotatably holding a coil of tack strip between the two parallel rods 12, 14. In one embodiment, this releasable means comprises a transverse hole drilled through the two lower ends of the rods 12, 14, and a cotter pin 34 or some other readily removable fastener which will mate with said hole. It will perhaps also be advantageous to provide a core 36 of plastic or wood or the like, with said core having a diameter such that it will readily fit inside the center of a roll of commercially available tack strip. By providing such a core 36, the coiled tack strip will be held within the rods near its center, and no doubt it will turn more readily when an end portion is being manually pulled off the periphery of the roll. A suitable core is a disc of nylon or the like, having a diameter of at least two inches and a thickness of about ½ inch.

At the other end of the portable apparatus 10 is a ring 40 which is rigidly affixed to the two parallel rods 12, 14, as by welding. Said ring 40, which may be conveniently cut from a piece of tubular steel, has an axis which is established so as to be perpendicular to the plane which is generally defined by the two parallel rods 12, 14 and the U-shaped foot 26. Too, the ring 40 is preferably fairly large, e.g., ½ inch in diameter, so that it may be easily suspended from a nail or the like which is driven into a planar surface. In such a case, a roll R of coiled material in the holder 10 will rest generally flush against said planar surface, contributing to the secure and clean storage of said material. At any time that an upholstery worker wishes to work at a remote location, however, he need only grasp the apparatus 10 and carry it with him. (The holder itself typically weighs less than a pound, even when it is made of steel).

The apparatus 10 is noteworthy for its stability in maintaining the coiled material in a tight roll. This is so because the U-shaped foot 26 provides a remote restraint point in the plane defined by an initially flat coil of tact strip; and said remote restraint point is effective to prevent sideward movement of a peripheral segment of the tack strip in a direction perpendicular to the plane of the coil. Of course, the remote restraint point is at the periphery of the coil R, and it is located approximately 90° from a radial line parallel to the rods 12, 14. In effect, then, the coiled material is restrained at three widely spaced points which, according to basic geometric principles, define a plane. The location of one of the three restraint points never changes, namely, a designated point adjacent the core 36. The other two of the three restraint points progressively move inwardly as segments of the tack strip are torn from the periphery of the roll—and the roll's diameter is thereby reduced. One of these movable restraint points will be recognized as the U-shaped foot 26. The other of the two movable points coincides with the intersection of the roll's periphery with the two rods 12, 14. Of the two movable restraint points, movement of that point immediately adjacent the rods 12, 14 occurs naturally, by virtue of simply decreasing the roll's periphery. The other movable restraint point occurs by virtue of the biasing action of the spring 30 working against the pivotable arm 18. When the spring 30 is stretched, it naturally causes the U-shaped foot 26 to press radially inward against the periphery of the coiled tack strip. A preferred radial force applied against the tack strip is on the order of three pounds. And, of course, the inwardly pointing legs of the U-shaped member 26 prevent sideward sliding of a peripheral layer of the coiled material. By making the upstanding legs at least ¼ inch deep, several layers of the ribbon-like material will be held in place by the foot 26; and the entire assembly will be a rather rigid unit.

The holder 10 is also noteworthy in that its length (which is basically established by the length of the two rods 12, 14) is less than the diameter of a roll of tack strip which the holder can receive and securely hold. That is, a holder 10 measuring less than 16 inches from tip-to-tip can readily accomodate a roll of tack strip having an initial diameter of 20 inches. And, the roll of material is held substantially the same after it has been nearly consumed as it was when it was new and full. By sizing the arm 18 so that the foot 26 moves through an arc that passes through approximately the center of the core 36, essentially the same kind of three-point restraint will be applied to the roll throughout its life.

While only a preferred embodiment of the invention has been disclosed in great detail herein, it will be apparent to those skilled in the art that modifications thereof can be made without departing from the spirit of the invention. Thus, the specific structure shown herein is intended to be exemplary and is not meant to be limiting, except as described in the claims appended hereto.

What is claimed is:

1. Portable apparatus for holding and dispensing a coiled strip of ribbon-like material, with the initial radius of a full coil having a given size which is substantially larger than the width of said coiled material, comprising:

(a) a pair of parallel rods rigidly connected at the first ends thereof, with the length of said rods being substantially longer than the radius of a full coil of the strip of ribbon-like material, and the separation of the pair of rods being only slightly greater than the width of the ribbon-like material, such that the rods serve to restrain the sides of the coil of material against movement in an axial direction;

(b) an arm pivotably connected to the pair of parallel rods at a point intermediate the length of said arm and relatively near one end thereof, so as to divide the arm into longer and shorter portions, with the arm being mounted between the pair of rods, and the pivot location on said pair of rods being relatively near their rigidly connected ends, and the longer portion of the arm being curved inwardly to the extent that its distal end lies near the periphery of a coil of the ribbon-like material when said coil is mounted in the apparatus, and the distal end of said longer portion of the pivoted arm defining an arc as the material is progressively removed from the coil at the periphery thereof, and the length of said longer arm portion is such as to cause said arc to extend approximately through the center of the coiled material;

(c) means for releasably and rotatably holding a coil of ribbon-like material between the two parallel rods, with said means including a rigid core having a diameter of at least two inches and being so thin as to permit the parallel rods to bear directly against the sides of the coiled material, and further including a removable fastener for holding the rigid core between the second ends of the two parallel rods, such that the apparatus may be rotated about any axis and turned through any angle without causing the coil of ribbon-like material to fall out of the apparatus;

(d) a spring mounted for biasing the arm toward general longitudinal alignment with the two parallel rods; and (e) a generally U-shaped foot secured to the dital end of the longer portion of the pivoted arm, with the open part of the foot being oriented inwardly toward the rods, and the gap between the two legs of the U-shaped foot being just slightly wider than the width of the coiled material, such that the U-shaped foot can both encompass and bear radially against a peripheral portion of the coil of ribbon-like material which is held between the two parallel rods, and the length of the two legs of the U-shaped foot being substantially less than the radius of the rigid core, whereby interference between the two rods and a projecting leg of the U-shaped foot is precluded, and the base of said foot will therefore press radially against the periphery of the coiled material until the very last increment of said material is dispensed from the apparatus.

2. The material-holding apparatus as claimed in claim 1 wherein the removable fastener for holding the rigid core constitutes a cotter pin which is positioned at the second ends of the parallel rods and extending therebetween so as to releasably secure said second ends together, and the spacing of the second ends being adjustable so as to accommodate ribbon-like material of unequal thickness from coil to coil.

3. The portable apparatus as claimed in claim 1 and further including a ring rigidly affixed to the two parallel rods, with said ring constituting a structural means by which the first ends of the two parallel rods are rigidly connected, and said ring having an axis which is perpendicular to that plane which is generally defined by the two parallel rods and the U-shaped foot, whereby the ring may be suspended from a nail partially driven into a planar surface so that the coil material may rest against the surface below said nail.

4. The portable apparatus as claimed in claim 1 wherein the pivotable arm is slightly longer than the two parallel rods, and the pivot point for said arm is located so as to divide the arm into portions whose lengths have a ratio of about 4:1, and the spring is attached to that end of the arm adjacent the shorter portion, and wherein the spring causes radial forces on the order of three pounds to be exerted by the U-shaped foot on the ribbon-like material.

5. The portable apparatus as claimed in claim 1 wherein each of the two parallel rods and the arm are made from ¼ inch steel rod having a generally square cross section, and wherein the weight of the apparatus is less than one pound.

* * * * *